United States Patent [19]

Allee

[11] 4,323,131

[45] Apr. 6, 1982

[54] REMOVABLE ANTI-WEAR INSERT

[75] Inventor: Jimmy L. Allee, Houston, Tex.

[73] Assignee: Baker Service Company, Inc., Houston, Tex.

[21] Appl. No.: 185,152

[22] Filed: Sep. 8, 1980

[51] Int. Cl.[3] ..... E21B 10/62; E21B 17/10; E21B 17/12

[52] U.S. Cl. ..... 175/413; 175/325; 308/4 A

[58] Field of Search ..... 175/413, 410, 412, 374, 175/375, 325; 308/4 A, 239

[56] References Cited

U.S. PATENT DOCUMENTS

| | | | |
|---|---|---|---|
| 3,389,761 | 6/1968 | Ott | 175/374 |
| 3,603,414 | 9/1971 | Stebley | 175/374 |
| 3,717,209 | 2/1973 | Sheldon et al. | 175/374 X |
| 3,771,612 | 11/1973 | Adcock | 175/413 |
| 3,852,874 | 12/1974 | Pearson | 175/410 X |
| 4,190,124 | 2/1980 | Terry | 175/325 X |
| 4,199,035 | 4/1980 | Thompson | 175/413 X |
| 4,245,709 | 1/1981 | Manuel | 175/325 |

*Primary Examiner*—Stephen J. Novosad

*Attorney, Agent, or Firm*—Pravel, Gambrell, Hewitt, Kirk, Kimball & Dodge

[57] ABSTRACT

A removable anti-wear insert adapted to be mounted in the bore of a tool body, the insert being removable after wear with minimal damage to the tool body. The removable insert has a bore therein mounting an extractor sleeve, the sleeve having a threaded portion. Upon sufficient wear, the extractor sleeve threaded portion is exposed so that a set screw already mounted therein, or a separate bolt, can be rotated inwardly into engagement with the bottom of the tool body bore to force the insert upwardly out of the tool body bore. The head of the bolt threadedly mounted in the extractor sleeve shaft within the insert bore can be used as a point of leverage for pulling the insert out of the hole.

12 Claims, 8 Drawing Figures

FIG. 1
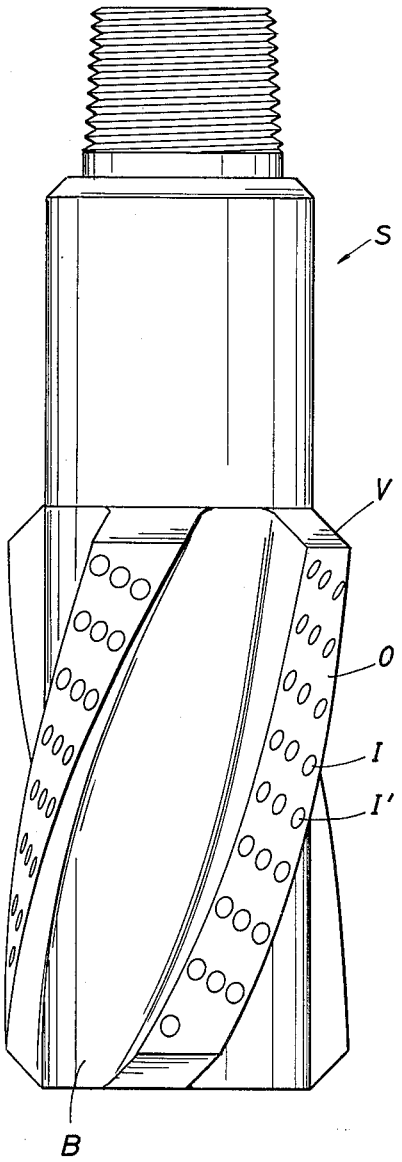
FIG. 2
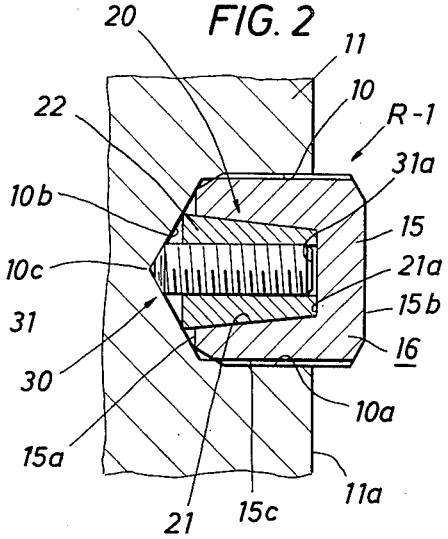
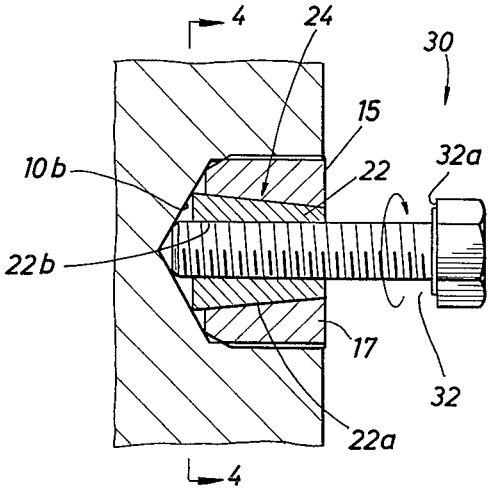
FIG. 3
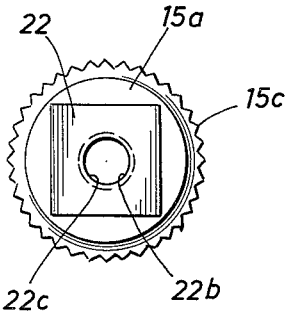
FIG. 4

REMOVABLE ANTI-WEAR INSERT

TECHNICAL FIELD

The field of this invention relates to removable anti-wear inserts mounted in tools normally subject to high wear.

PRIOR ART

Tool bodies such as reamers and stabilizers utilized in oil well drilling normally receive a great deal of wear. For example, in the utilization of stabilizers, which are mounted onto the drill string near the drill bit, the rotation of the stabilizer in engagement with the formation being drilled through can cause extreme wear to the stabilizer body. It is known to utilize inserts of wear-resistant material such as tungsten carbide mounted into the vanes of the stabilizer body in order to provide wear resistant areas for engaging the formation thereby increasing the overall life of the stabilizer tool. In addition to the use of tungsten carbide inserts in stabilizers and other oil well drilling tools, other types of tool bodies also have need for wear resistant inserts implanted in the tool body to increase the overall wear and protection of the tool body.

In such tools, both in oil well drilling operations and other applications, it is often desirable to re-work these tools after a certain amount of wear by replacing the wear-resistant inserts and thus rejuvenating the tool for further use. However, it has been expensive to remove these worn inserts from the tool body so that the tool body can be re-worked and new insert bores drilled therein to receive fresh inserts. Normal means of removing implants such as drilling cannot be utilized due to the hardness of the insert, making it necessary to use a torch or other cutting means to cut the insert out of the tool body, which causes undesirable additional damage to the tool body that must also be repaired before new inserts can be implanted.

SUMMARY OF THE INVENTION

This invention relates to a new and improved removable anti-wear insert adapted to be mounted in a bore of a tool body and which can be removed after wear with minimal damage to the tool body. The removable anti-wear inserts of this invention include a wear-resistant insert body having first and second end surfaces and a side surface configuration adapted to substantially conform to the configuration of a bore in a tool body. The first surface of the insert is adapted to be positioned within the tool body bore and a bore is formed in this first surface and extends into the insert, itself. This insert bore, however, does not extend all the way through the wear-resistant insert; rather, an end portion formed with the second end of the insert body is solid or otherwise formed of wear-resistant material which is adapted to extend outwardly of the tool body for exposure as a wear surface. Extractor means is mounted in the insert body bore, which is thus formed in the normally unexposed portion of the insert body, to provide for the removal of the insert after wear.

The extractor means of this invention includes an extractor sleeve mounted in the insert body bore and having an exterior configuration conforming to the configuration of the insert body bore and a threaded bore extending therethrough, which bore is eventually exposed upon wear of the insert body. A force-application means is mounted in the threaded bore of the extractor sleeve. In one embodiment, the force-application means is a set screw which is mounted in the threaded bore prior to insertion of the insert body into the tool body and which is exposed after sufficient wear of the insert body. Upon exposure, the set screw can be rotated downwardly into the bottom of the tool body bore thus forcing the insert body upwardly out of the tool body bore. In another embodiment, the set screw may be removed or not used at installation, and a bolt or cap screw can be inserted into the bore of the extractor sleeve after sufficient wear to allow the application of greater rotation force to force or wedge the insert out of the tool body bore.

BRIEF DESCRIPTION OF THE DRAWINGS

FIG. 1 is a side view of a stabilizer utilized in oil well drilling, the stabilizer shown being exemplary of the type of tool in which this invention may be utilized;

FIG. 2 is a side view in section of the removable anti-wear insert of a preferred embodiment of this invention illustrating the insert in position prior to wear;

FIG. 3 is a side view in section similar to FIG. 2 wherein the insert has been worn to expose the extractor means mounted within the insert;

FIG. 4 is an end view taken along line 4—4 of FIG. 3;

DESCRIPTION OF THE PREFERRED EMBODIMENT

Figure 5:
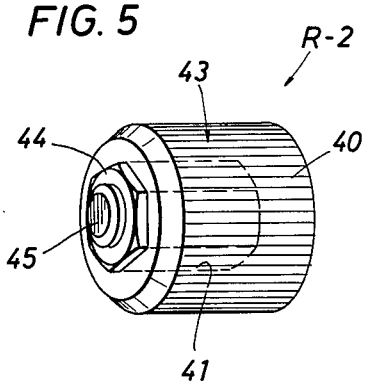
FIG. 5 is a perspective view of an alternate embodiment for the anti-wear insert of the preferred embodiments of this invention wherein the extractor sleeve has a different configuration than the extractor sleeve of the extractor means illustrated in FIGS. 2–4.

Referring to the drawings, and in particular to FIG. 1, the letter S designates a stabilizer tool utilized in oil well drilling operations. Typically, one or more of the stabilizers are mounted with the drill string extending from the drilling platform down to the drill bit which actually engages the bottom of the formation and creates the oil well drilling borehole. Stabilizers S are mounted in the drill string to maintain the drill string in a proper position within the borehole and thus engage the sides of the borehole during rotation of the drill string. Typically, the vanes V which extend outwardly from the body B of the stabilizer S have implanted in outer surface O a series of hard-surfaced inserts I. The purpose of such inserts are to provide wear areas on the body B of the stabilizer S which actually engage the sides of the borehole, the formation, and thus serve as points of wear resistance for the stabilizer body B. It is known that such wear-resistant inserts should be made of very hard, wear-resistant material or at least be treated so that the surface of the inserts are extremely hard and wear resistant. A good example of such an insert is the tungsten carbide insert having a surface treated with a very hard tungsten carbide material. These inserts I thus provide points of wear which serve to increase the overall life of the stabilizer by protecting the stabilizer body B from wear.

It is often desirable to re-use the worn stabilizer S after removal from the drill string. In order to repair or reconstruct such a tool as the stabilizer S, it is first necessary to remove the inserts I, which are typically press-fitted into boreholes in the outside surface O of the vanes V on stabilizer body B. Due to the hardness of the inserts I, it is very difficult to simply drill the inserts out. Rather, it is typically necessary to use a torch or other cutting means to actually cut the inserts out of the body B of the stabilizer S. Of course, such cutting by torch or other means additionally damages the body and thus creates more work that must be done to prepare the body B for reuse.

This invention is directed to a removable anti-wear insert I' which may be mounted in tool bodies such as the body of B of the stabilizer S and, upon wear, may be removed with minimal damage to the body B of the tool. It is contemplated that the removable anti-wear insert I' of this invention can be utilized in conjunction with various types of tools wherein inserts I are presently used. And, in addition, due to the facile of removal of the inserts I' of this invention, such inserts can be utilized in other applications where tool bodies of various types need protection against wear.

Figure 6:
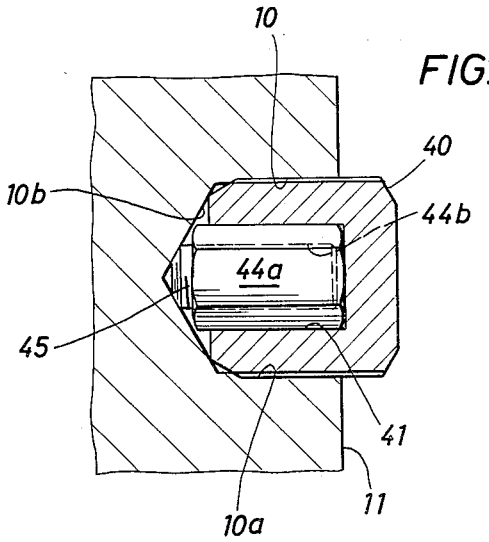
FIG. 6 is a side view partly in section of the anti-wear insert illustrated in FIG. 5.
Figure 7:
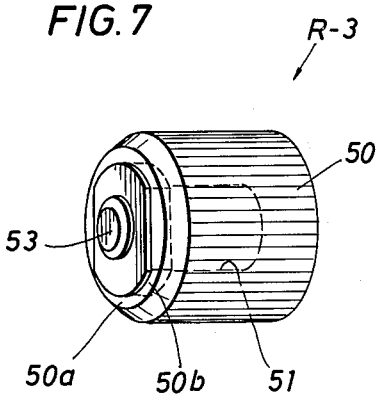
FIG. 7 is a perspective view of another embodiment of the preferred embodiments of this invention wherein the extractor sleeve is T-shaped.
Figure 8:
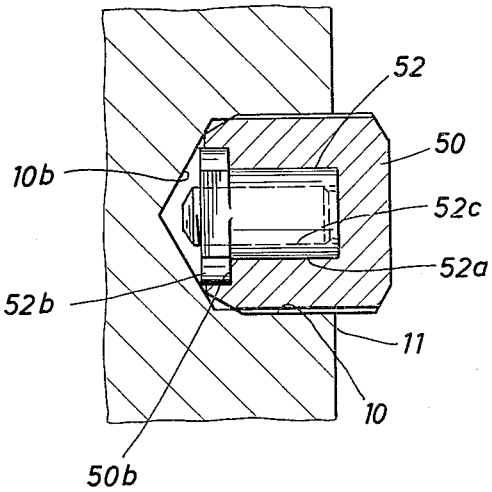
FIG. 8 is a side view partly in section further illustrating the insert of FIG. 7.

The new and improved inserts I' of this invention are designated as R-1, R-2 and R-3 in FIGS. 2–8. Referring specifically to the remaining Figures, FIGS. 2–4 illustrate removable insert R-1 of one embodiment of this invention. Embodiment R-2 is illustrated in FIGS. 5 and 6 and embodiment R-3 is illustrated in FIGS. 7 and 8.

Referring now to the embodiment R-1 of FIGS. 2–4, the removable insert R-1 is mounted in a bore 10 in surface 11*a* of tool body 11, which may represent the tool body B of the stabilizer S or other tool body to which this invention has application. In the embodiment illustrated in FIGS. 2–4, the tool body bore 10 is generally cylindrical in configuration and includes a cylindrical side surface area or wall 10*a* and a conical bottom surface 10*b* terminating in an internal apex 10*c* formed in alignment with the central axis of the bore 10.

The removable anti-wear insert 15 of the embodiment of the invention illustrated in FIGS. 2–4 is generally cylindrical in configuration and includes first and second end surfaces 15*a* and 15*b*, respectively, and a cylindrical side surface 15*c*. The cylindrical side surface 15*c* may be serrated as shown in FIG. 4. The outside diameter of the insert side surface 15*c* is substantially the same as the diameter of the cylindrical wall surface 10*a* of the bore 10 so that the insert 15 is mounted into the bore 10 with sufficient press fit to hold the insert 15 in position during use.

FIG. 2 illustrates the insert 15 as it is mounted in the tool body bore 10 prior to use. In such initially mounted position, the removable insert 15 includes a wear section or portion 16 which extends outwardly from the surface 11*a* of the tool body 11. The second insert surface 15*b* and that portion of the side surface 15*c* of the insert 15 which extends outwardly from the surface 11*a* cooperate to form this protruding, wear portion 16. It is this wear portion which receives the brunt of engagement with the formation when the removable insert is utilized on a stabilizer S such as illustrated in FIG. 1.

The remainder of the cylindrical side surface 15*c* of the removable insert 15 cooperates with the bottom surface 15*a* to form the initially unexposed section or portion 17 of the removable insert 15. It should be understood that the wear section or portion 16 as herewith described may vary in size relative to the size of the entire insert depending upon the overall size of the removable insert R-1, the depth of the bores in the tool body in which it is used, the number of inserts being utilized, the nature of the application and perhaps other factors. Of course, the dividing line between the wear portion 16 and the initially unexposed portion 17 of the insert will typically be a line or plane in alignment with the surface 11*a* of the tool body 11. Also, in FIG. 2 the wear portion 16 of insert R-1 is solid and integral with the insert body 15. It is within the scope of this invention that that wear portion may in part be made of another material. For example, the wear portion may have a plugged area or bore portion.

Extractor means generally designated by the number 20 is mounted in the removable insert R-1 for removing the insert R-1 after it has been worn down to approximately the size illustrated in FIG. 3, which illustrates the previously unexposed insert portion 17 as being the only portion of the insert remaining. It is contemplated that such an insert will typically need replacing after the protruding portion 16 has been worn off. The extractor means generally designated as 20 is provided for mounting substantially in the previously unexposed portion 17 of the removable insert 15 to provide for the removing of the remaining portion of the insert 15 after such predesigned wear has occurred. The extractor means 20 is designed to be exposed after such predesigned wear has occurred and to provide means for extracting or removing the insert R-1 with minimal damage to the tool body. The insert 15 has a bore 21 formed therein. In the embodiment illustrated in FIGS. 2–4, the bore 21 is a polygonal bore of a four-sided or square variety which is tapered inwardly in the direction from the first insert surface 15*a* toward the second or outer insert surface 15*b*. The bore 21 terminates in a transverse internal bore end surface area 21*a* which is four-sided. The distance between the first or inside insert surface 15*a* and the internal bore end area 21*a* is such that the internal surface 21*a* is in approximate alignment with the outer surface 11 of the tool body B. Thus, the internal bore end surface 21*a* forms the approximate dividing line between the insert wear portion 16 and the unexposed insert portion 17 illustrated in FIG. 3.

The extractor means 20 further includes an extractor sleeve 22 having a four-sided, tapered exterior surface configuration 22*a* complementary to the four-sided, tapered configuration of the insert bore 21 so that the extractor sleeve 22 can be inserted into the insert bore 21. The extractor sleeve 22 may be held in such position until installation of the insert R-1 by an epoxy or other means. The extractor sleeve 22 includes a threaded bore 22*b* which extends through the center of the sleeve 22 along the common axis (not numbered) of the extractor sleeve 22, insert 15 and bore 10 in the tool body B. The extractor sleeve bore 22*b* is threaded and thus includes a series of threaded shoulders such as 22*c* substantially transverse to the direction of extraction of the insert 15 and which may be used as gripping or wedging points to wedge or pull the insert 15 out of the tool body bore 10 by means of a force-application means generally designated as 30.

Referring to FIG. 2, a set screw 31 is positioned in the threaded bore 22*b* of the extractor sleeve 22 at the time that the insert 15 is placed in the tool body bore 10. It is noted that the removable insert R-1 is illustrated in its initial position prior to wear in FIG. 2. In such position, the insert body 15 includes a wear portion 16 which protrudes from the tool body surface 11*a*. And, the extractor sleeve 22 and set screw 31 are positioned in the insert bore 21. During operation, the wear portion 16 is gradually worn away until the insert bore 21, extractor sleeve 22 and set screw 31 are exposed. With the wear portion 16 expended, it is considered time to remove the insert R-1. The set screw 31 has a groove 31*a* in the top to receive a screw driver so that the set screw may be rotated downwardly into engagement with the bottom 10*b* of the tool body bore 10. Further rotation of the screw inwardly into the tool body will cause the extractor sleeve surface 22*a* to press against the internal end bore surface 21 which transmits the outwardly directed force to the insert body 15 itself thus pushing the insert body 15 outwardly. In this manner, the set screw 31 may act as a force-application means 30.

Another version of the force-application means 30 is illustrated in FIG. 3. In FIG. 3, the tool body insert is shown in its worn position with the extractor sleeve 22 exposed. During the period of initial wear, the set screw 31 can be utilized in the position illustrated in FIG. 2 to provide additional structural integrity to the removable insert R-1. Instead of using the set screw 31 as the force-application means 30, the set screw 31 may be removed and replaced with the bolt or cap screw 32 illustrated in FIG. 3. The cap screw 32 is screwed into the extractor sleeve bore 22*b* and is then further rotated downwardly into engagement against the bottom 10*b* of the tool body bore 10. Further rotation in the direction of the arrows illustrated in FIG. 3 will move the worn insert outwardly. The outward force caused by the camming action of the threads as the bolt 32 is rotated is transmitted to the extractor sleeve exterior surface 22*a* and then, through the tapered complementary surfaces between the extractor sleeve surface 22*a* and the insert bore 21, to the worn insert in order to push the worn insert 15 outwardly. In the alternative, it is within the scope of this invention to utilize the extracting bolt or cap screw 32 without the set screw 31 so that upon initial installation of the removable insert R-1 as illustrated in FIG. 2, the set screw 31 is not used.

The force-application means 30 may also utilize the cap screw 32 in a somewhat different manner in that, instead of rotating the cap screw 32, the undersurface 32*a* of the cap screw may be pushed against by any suitable tool to force or pull the insert body 15 outwardly.

The removable insert R-2 illustrated in FIG. 5 basically operates upon the same principles as the removable insert R-1. Where the structure and function of the parts to be discussed in the FIG. 5 embodiment R-2 are the same as the R-1 embodiment described with respect to FIGS. 2–4, the same numbers and letters will be utilized. The removable insert body 40 is again generally cylindrical but has a polygonal bore 41 of a hexagonal configuration formed therein instead of the four-sided bore illustrated in FIGS. 2–4. The insert 40 is mounted in a tool body bore 10 formed in tool body outside surface 11*a*, the tool body bore 10 having a bottom end 10*b* and a cylindrical side surface or wall 10*a*.

The extractor means generally designated as 43 includes an extractor sleeve 44 having a hexagonal outer surface 44*a* and a threaded bore 44*b* therein adapted to receive a set screw 45 which may be inserted into the extractor sleeve bore 44*b* prior to placement of the removable insert R-2 in its initial position illustrated in FIG. 6. As described previously with respect to the removable insert R-1, the set screw 45 and extractor sleeve 44 becomes exposed after the insert 40 is sufficiently worn and thereafter, the set screw 45 may be rotated to push the previously unexposed portion of the insert body 40 outwardly. In the alternative, the set screw may be removed and replaced by a cap screw 32 (FIG. 3) for the purposes of removing the insert 40. The cap screw may be rotated in order to press downwardly against the bore bottom 10*b* to push the remaining part of the insert body 40 outwardly of the tool body 10 or, the undersurface of the head of the cap screw may be utilized as a leverage point for the utilization of any other tool suitable for pulling or camming the remaining part of the body 40 outwardly.

Referring now to FIGS. 7 and 8, the removable insert R-3 is illustrated. The removable insert R-3 again includes a cylindrical insert body 50 having a threaded bore 51 therein. However, in addition to the threaded bore 51, the inner end surface 50*a* of the insert 50 includes a transverse slot or grooved portion 50*b*. The extractor sleeve 52 generally includes a cylindrical portion 52*a* and a transverse, end section 52*b* which may be fitted into the slot 50*b* on the insert body 50. A set screw 53 is mounted in the inside threaded bore 52*c* of the extractor sleeve 52. After sufficient wear, the set screw may be utilized to force the insert body 50 outwardly. Here, the necessary outward force exerted by forcing the set screw 53 against the bore bottom 10*b* is transmitted to the remaining part of the insert body 50 through the transverse end portion 25*b* and its engagement against the surfaces forming the slot 50*b* in the insert body end face 50*b*. Again, the set screw 53 may be removed and the force-application means 30 may be provided by the cap screw 32.

The foregoing disclosure and description of the invention are illustrative and explanatory thereof, and various changes in the size, shape and materials as well as in the details of the illustrated construction may be made without departing from the spirit of the invention. For example, although the insert bores have been described as being polygonal, it is within the scope of this invention for such bore to be a tapered cylinder also.

I claim:

1. A removable anti-wear insert adapted to be mounted in a bore of a tool body and which can be removed after wear with minimal damage to the tool body, comprising:

a wear resistant insert body having first and second end surfaces and a side surface configuration therebetween adapted to substantially conform to the configuration of a bore in a tool body, said first surface of said insert being positionable within said tool body bore, said insert having a bore located in said first surface and extending into said insert body, said second surface of said insert body and a portion of said body forming a wear portion adapted to protrude outwardly of said tool body bore to provide a predesignated wear surface to increase the life of said tool body, the remainder of said insert body formed by said first end surface and said side surface providing an initially unexposed portion adapted to be positioned in said tool body; and extractor means mounted in said insert body bore and being adapted to be located with said initially unexposed portion of said insert body in said tool body bore, said extractor means being exposed upon wear of said wear portion of said insert for extracting said insert from tool body bore.

2. The structure set forth in claim 1, wherein said extractor means includes:

an extraction member having a shoulder formed therewith, said shoulder being substantially transverse to the direction of extraction; and a force-application means for applying a removal force to said extraction member shoulder for removing said insert from said tool body bore.

3. The structure set forth in claim 1, wherein said extractor means includes:

an extractor sleeve mounted in said insert body bore, said extractor sleeve having an exterior surface configuration conforming to the configuration of said insert body bore and a threaded bore extending therethrough, which bore is exposed upon wear of said wear portion of said insert body.

4. The structure set forth in claim 3, wherein said extractor means further includes:

a screw shaft mounted in said threaded bore of said extractor sleeve for installation with said extractor sleeve and insert body in said tool body bore, said screw shaft being exposed upon wear of said wear portion of said insert body.

5. The structure set forth in claim 4, including:

said screw shaft having a groove therein to receive a tool for rotating said screw shaft to cause said screw shaft to engage the bottom of said tool body bore and force said insert body outwardly of said tool body bore.

6. The structure set forth in claim 4, wherein said extractor means further includes:

said screw shaft being removable from said extractor sleeve bore upon exposure of said bore after said wear portion of said insert body is expended.

7. The structure set forth in claim 6 or 3, wherein said extractor means includes:

a force-application means including a removable bolt mounted in said exposed threaded bore of said extractor sleeve and having a bolt head thereon.

8. The structure set forth in claim 7, including:

said bolt head being rotatable for rotating said bolt within said exterior sleeve bore into engagement with the bottom of said tool body bore to force said insert body outwardly of said tool body.

9. The structure set forth in claim 7, including:

said bolt head providing an undersurface adapted to be engaged by a removal tool for pulling said insert body out of said tool body bore.

10. The structure set forth in claim 3, wherein:

said extractor sleeve exterior surface is tapered inwardly in a direction from said first toward said second end surfaces of said insert body.

11. The structure set forth in claim 10, wherein:

said extractor sleeve exterior surface is polygonal.

12. The structure set forth in claim 3, wherein:

said extractor sleeve includes a transverse portion positioned in engagement with said first end surface of said insert body.

* * * * *